US010130952B2

(12) United States Patent
Sabol et al.

(10) Patent No.: US 10,130,952 B2
(45) Date of Patent: Nov. 20, 2018

(54) HIGH FLOW HIGH CAPTURE SIDE RAILS FOR COMMINUTOR

(71) Applicant: JWC ENVIRONMENTAL, LLC, Costa Mesa, CA (US)

(72) Inventors: Rob Sabol, Aliso Viejo, CA (US); Daniel McHugh, New Prague, MN (US); Kevin Moir, Capistrano Beach, CA (US); Corey Glauberman, Tustin, CA (US); Todd Nydam, Newport Beach, CA (US)

(73) Assignee: JWC Environmental, LLC, Costa Mesa, CA (US)

( * ) Notice: Subject to any disclaimer, the term of this patent is extended or adjusted under 35 U.S.C. 154(b) by 476 days.

(21) Appl. No.: 14/862,238

(22) Filed: Sep. 23, 2015

(65) Prior Publication Data

US 2016/0082442 A1 Mar. 24, 2016

Related U.S. Application Data

(60) Provisional application No. 62/054,667, filed on Sep. 24, 2014.

(51) Int. Cl.

| | |
|---|---|
| ***B02C 18/00*** | (2006.01) |
| ***B02C 18/14*** | (2006.01) |
| ***B02C 18/18*** | (2006.01) |
| *B02C 18/16* | (2006.01) |

(52) U.S. Cl.

CPC ..... *B02C 18/142* (2013.01); *B02C 18/16* (2013.01); *B02C 18/18* (2013.01); *B02C 2018/162* (2013.01); *B02C 2018/188* (2013.01)

(58) Field of Classification Search

CPC ..... B02C 18/142; B02C 18/16; B02C 18/18; B02C 18/162

USPC ..... 241/236

See application file for complete search history.

(56) References Cited

U.S. PATENT DOCUMENTS

| | | | | |
|---|---|---|---|---|
| 3,396,914 A * | 8/1968 | Liebman | B02C 18/0007 | 241/187 |
| 3,682,396 A * | 8/1972 | Whitney | B02C 18/0084 | 241/41 |
| 4,399,946 A * | 8/1983 | Stevenson | B02C 18/142 | 241/21 |
| 5,169,078 A * | 12/1992 | Lamar | B02C 18/142 | 241/166 |

(Continued)

*Primary Examiner* — Faye Francis

(74) *Attorney, Agent, or Firm* — Sughrue Mion, PLLC

(57) ABSTRACT

An apparatus for comminuting solid waste material is provided. The apparatus includes a casing and a comminutor assembly including a plurality of cutting elements mounted on said first shaft in interspaced relationship with a plurality of second cutting elements mounted on said second shaft. The casing includes laterally opposed side rails each having a wall extending parallel to the flow direction of the liquid through the comminution chamber, a plurality of planar fins projecting outwardly of said rear wall in the direction of said stack, aligned with the flow direction of the liquid and being spaced from each other in a vertical direction to form slots therebetween, and the planar fins having a leading edge extending from the wall upstream a rearward edge, the rearward edge extending from an outermost portion of the leading edge toward the wall, and the fins have a path ratio greater than 1.55 to 1.

20 Claims, 19 Drawing Sheets

(56) References Cited

U.S. PATENT DOCUMENTS

| | | | | |
|---|---|---|---|---|
| 5,199,666 | A * | 4/1993 | Williams | B02C 18/142 241/236 |
| 5,556,039 | A * | 9/1996 | Minamimura | B02C 18/142 241/158 |
| 6,241,170 | B1 * | 6/2001 | St. Clair | B02C 18/0007 241/166 |
| 6,616,077 | B2 * | 9/2003 | Koenig | B02C 18/142 241/230 |
| 7,007,878 | B2 * | 3/2006 | Strong | B02C 18/142 241/236 |
| 2002/0195510 | A1 * | 12/2002 | Lin | B02C 18/0007 241/236 |
| 2003/0089806 | A1 * | 5/2003 | Galanty | B02C 18/0092 241/46.06 |
| 2004/0118957 | A1 * | 6/2004 | Papajewski | B02C 4/08 241/236 |
| 2005/0242221 | A1 * | 11/2005 | Rota | B02C 18/142 241/236 |

* cited by examiner

| TEST CONDITION | STAPLING (1" wide strips, hand fed) |
|---|---|
| Production Siderail (Prior Art) | 60% |
| "Cheese Wedge" (New Art) | 0% |
| "Half Shield" (New Art) | 0% |

FIG. 12

| Station | L | % |
|---|---|---|
| 0 | 3.178 | 100.0% |
| 1 | 3.078 | 96.9% |
| 2 | 2.978 | 93.7% |
| 3 | 2.878 | 90.6% |
| 4 | 2.778 | 87.4% |
| 5 | 2.666 | 83.9% |
| 6 | 2.506 | 78.9% |
| 7 | 2.046 | 64.4% |
| Path Ratio | 1.55 | :1 |

| Station | L | % |
|---|---|---|
| 0 | 2.800 | 100.0% |
| 1 | 2.717 | 97.0% |
| 2 | 2.620 | 93.6% |
| 3 | 2.508 | 89.6% |
| 4 | 2.378 | 84.9% |
| 5 | 2.229 | 79.6% |
| 6 | 2.058 | 73.5% |
| 7 | 1.862 | 66.5% |
| 8 | 1.634 | 58.4% |
| 9 | 1.363 | 48.7% |
| Path Ratio | 2.05 | :1 |

| Station | L | % |
|---|---|---|
| 0 | 2.800 | 100.0% |
| 1 | 2.613 | 93.3% |
| 2 | 2.418 | 86.4% |
| 3 | 2.216 | 79.1% |
| 4 | 2.007 | 71.7% |
| 5 | 1.789 | 63.9% |
| 6 | 1.563 | 55.8% |
| 7 | 1.326 | 47.4% |
| 8 | 1.079 | 38.5% |
| 9 | 0.819 | 29.3% |
| Path Ratio | 3.42 | :1 |

| Station | L | % |
|---|---|---|
| 0 | 2.160 | 100.0% |
| 1 | 1.976 | 91.5% |
| 2 | 1.793 | 83.0% |
| 3 | 1.609 | 74.5% |
| 4 | 1.425 | 66.0% |
| 5 | 1.241 | 57.5% |
| 6 | 1.058 | 49.0% |
| 7 | 0.874 | 40.5% |
| 8 | 0.690 | 31.9% |
| 9 | 0.507 | 23.5% |
| Path Ratio | 4.26 | :1 |

HIGH FLOW HIGH CAPTURE SIDE RAILS FOR COMMINUTOR

CROSS-REFERENCE TO RELATED PATENT APPLICATIONS

This application claims the benefit of U.S. Provisional Patent Application No. 62/054,667 filed on Sep. 24, 2014 in the U.S. Patent Trademark Office, the disclosure of which is incorporated herein in its entirety by reference.

BACKGROUND OF THE INVENTION

1. Field of the Invention

This invention relates to a solid waste comminution apparatus. Such devices have been established in the art and are now widely used in a variety of applications, such as municipal waste treatment and industrial applications. The devices typically employ two stacks of interleaving cutting elements to reduce solids. Structural elements to support the housings called side rails have been enhanced to not only provide support, but provide increased flow while still limiting the bypass of solids.

2. Description of the Related Art

Side rails are components of comminuting device designs, typically consisting of interleaved fins and slots, whose purpose is to intercept and redirect large particles in the waste stream into the cutter stack, while at the same time allowing water to pass through the slots between the fins. The leading surface of each fin begins at the inlet of the device and the trailing surface extends to the mid-depth of the comminutor or beyond. Water flow through the side rails is influenced by two factors, the gap distance and the length of flow passage between each fin. The leading surface of the fin is angled at the intended flow direction in an effort to direct material into the cutter stack (see Fig. III).

Referring to FIG. 1 of the drawings, a comminutor 10 is particularly useful in comminuting solid waste material borne by a liquid flowing through the interior of a casing 12. The casing forms a comminution chamber 14. The casing 12 is shown in vertical section to illustrate the components of the comminutor and the manner in which they achieve shredding of the solid waste. Purposely, this figure does not show the inlet port or outlet port which are on opposite sidewalls (not shown), into and out of the plane of the paper bearing FIG. 1.

The vertically upright, rectangular, cross sectional casing 12 includes a cast metal base 16 supported by a rectangular plate or cover 18 and bearing, in vertically upright position, a pair of side rails indicated generally at 20. Side rails 20 are connected at their bottoms by screws 22 to an upwardly projecting mounting plate 16*a* of base 16. At the top of casing 12, there is provided a mirror image cast metal casing head or upper frame member 24 of rectangular horizontal cross-section and which terminates, at it's bottom end, in a second mounting plate 24*a*. In similar fashion, further screws 22 project through the top of the side rails and are threaded within tapped holes (not shown) of head mounting plate 24*a*.

The first and second shredding stacks at 26 and 28 are mounted in mutual, parallel alignment for counter-rotation on drive shaft 30 and idler or driven shaft 32, respectively. Shaft 30 is supported by an upper bearing assembly 34 within head 24 and by a lower bearing assembly 36 within base 16 respective. Shaft 32 is similarly supported for rotation about its axis and parallel to the axis of the drive shaft 30 by upper bearing assembly 38 and lower bearing assembly 40, respectively. In similar fashion to U.S. Pat. No. 4,046,324, the stacks 26, 28 may be compressed between opposing bearing plates (not shown) by nuts 41 on shafts 30, 32 backed by washers 43. The drive shaft 30 includes a drive gear 42 which is in mesh with a similar size driven gear 44 fixed to the upper end of the driven shaft 32. Rotation of the drive shaft 30 effects counter-rotation of shafts 30 and 32 about parallel axes. Drive is affected by an electrical motor indicated generally at 46 powered from an electrical source (not shown) through control box 48. A motor shaft (not shown) of the drive motor 46 is coupled mechanically to drive shaft 30 through a gear reduction unit indicated generally at 50 for driving the comminutor drive shaft 30 at an appropriate RPM suitable to the comminuting of particular solid waste material to which the unit has application.

As previously described, each of the stacks 26, 28 is formed of a number of laminar cutting elements which are preferably of disk form. The cutting elements are directly mounted on the shafts 30, 32. The shafts may be of hexagonal cross sectional configuration with the cutting elements having corresponding holes or openings through the center of the same. The cutting elements 52, 54 are positioned between and separated in the axial direction along respective shafts 30, 32 by laminar spacers 56, 58, respectively, in the form of circular disks of reduced diameter with respect to the cutting elements 52, 54. Preferably the thickness of the cutting elements 52, 54 and the spacers 56, 58 are the same so that the laminar spacers of one stack are coplanar with cutting elements of the other stack. Thus, a cutting element from one stack and a spacer from the other stack form together a pair of interacting shredding members. While cutting teeth (not shown) integral with the cutting elements and projecting radially thereof overlap each other to the extent of their root diameters, there is always a slight gap between the outer periphery of the cutting element teeth of one stack and the periphery of the opposed laminar spacer of the other stack. Insofar as the present invention is concerned, the make-up, assembly, and the nature of the drive imparted to the cutting elements herein can be identical to that of U.S. Pat. No. 4,046,324.

The related art also relied on fins along the side walls that were horizontal (U.S. Pat. No. 5,593,100) to direct large particles into the cutter stack while allowing liquid to pass through the comminutor. If the material is in thin strips or sheets, the side rail can be prone to "stapling" where a strip of material wraps around the leading surface of a fin in a U shape. Eventually, a build-up of stapled material will block the flow through the side rail requiring operator intervention.

Another patent (U.S. Pat. No. 5,160,095) utilizes slots at an angle from horizontal. This exposes material passing through the slot to multiple cutter disks in the effort to reduce possible bypass. However, this also results in a higher pressure drop across the device, reducing hydraulic capacity. This design also demonstrates a tendency for stapling as a result of the rake angle of the leading surface of the fin.

Related art fins are shown in FIGS. 2A-4B. Each side rail 20 has a number of fins 100 separated by slots 110. Each slot has a predetermined gap height 115 and length 120. The leading edge 130 is formed with a rake angle 125 measured with respect to an orthogonal to the side wall surface. The fins are placed with a clearance 140 to the cutter elements of no closer than 0.16" in order to prevent unusually high pressure drops. The related art design is susceptible to stapling and inhibits flow in the wastewater system. The related art fins have a rake angle 125 of no less than 45 degrees.

Additionally, because of the large inlet to outlet pressure drop across the machine, prior side rail designs have large gaps between the side rail and the outside diameter of the cutter stack (typically on the order of 0.16" or greater) to allow water to flow between. This can also allow material to bypass the cutter stack.

Side rails with enhanced flow properties, are components of comminuting device, typically consisting of fins and slots, whose purpose is to intercept and redirect particles in the waste stream into the cutter stack, while at the same time allowing water to pass through the slots between the fins. The ratio of the fin thickness to the opening creates the open area for the side rail.

Previous designs to increase flow capacity through the side rail were either achieved by spacing the side rail further away from the cutters to create a gap between the side rail and the comminutor cutting elements or removing all of the fins from the side rail, which created a similar large gap as well. While these designs increased the flow capacity of the comminuting device, sometimes by as much 35%, this method of design significantly decreased the devices ability to capture and reduce solids. The comminuting devices ability to reduce solids is its main purposed for being installed in a waste stream.

SUMMARY OF THE INVENTION

According to an aspect of the present invention, there is provided an apparatus for comminuting solid waste material including a casing defining a comminution chamber and being open on opposite sides thereof for permitting the flow of liquid therethrough bearing solid waste material. The casing includes an underlying base and an overlying head. Also included is a comminutor assembly including cooperating substantially parallel first and second shredding stacks. The first and second stacks including first and second parallel shafts mounted for rotation at opposite ends within said base and said head respectively; and a plurality of cutting elements mounted on said first shaft in interspaced relationship with a plurality of second cutting elements mounted on said second shaft, said cutting elements being positioned between and separated in an axial direction by spacers which are coplanar with the cutting elements of the adjacent stack such that a cutting element from one stack and a spacer from the other stack form a pair of interactive shredding members, and wherein said casing includes laterally opposed side rails extending between the base and said head to the outside of respective stacks for controlling the flow of liquid through the comminution chamber from one side to the other and for causing the solid waste to be deflected into the path of rotating cutting elements of said stacks Each of the side rails includes a wall extending parallel to the flow direction of the liquid through the comminution chamber, a plurality of planar fins projecting outwardly of said rear wall in the direction of said stack, aligned with the flow direction of the liquid and being spaced from each other in a vertical direction to form slots therebetween.

According to another aspect, the planar fins have a leading edge extending from the wall upstream a rearward edge, the rearward edge extending from an outermost portion of the leading edge toward the wall, and the fins have a path ratio greater than 1.55 to 1. Additionally, the fins may have a path ratio ranging from 2.05-4.26 to 1.

According to another aspect, the leading edge has a rake angle, as defined with respect to a perpendicular from the side wall surface, within a range of 55 to 70 degrees.

According to another aspect, the leading edge of the fins is disposed upward in the flow direction from the cutting elements. A clearance is formed between the rearward edge of the fins and the cutter elements, the clearance being within the range of 0.10-0.15 inches, inclusive.

According to another aspect, the leading edge of the fins is adjacent the cutting elements. A clearance is formed between the leading edge of the fins and the cutter elements, the clearance being within the range of 0.10-0.15 inches, inclusive According to another aspect, the plurality of fins includes two rows of fins extending vertically, one row downstream in the flow direction from another row.

According to another aspect the fins of the one row and aligned with the slots of the other row.

According to another aspect, the fins of the one row and aligned with the fins of the other row.

BRIEF DESCRIPTION OF THE DRAWINGS

The above and other features and aspects of the present invention will become more apparent by describing in detail exemplary embodiments thereof with reference to the attached drawings in which:

FIG. 12 is a table showing test results;

DETAILED DESCRIPTION OF THE INVENTION

The present invention will now be described more fully with reference to the accompanying drawings, in which exemplary embodiments of the invention are shown.

Figure 1:
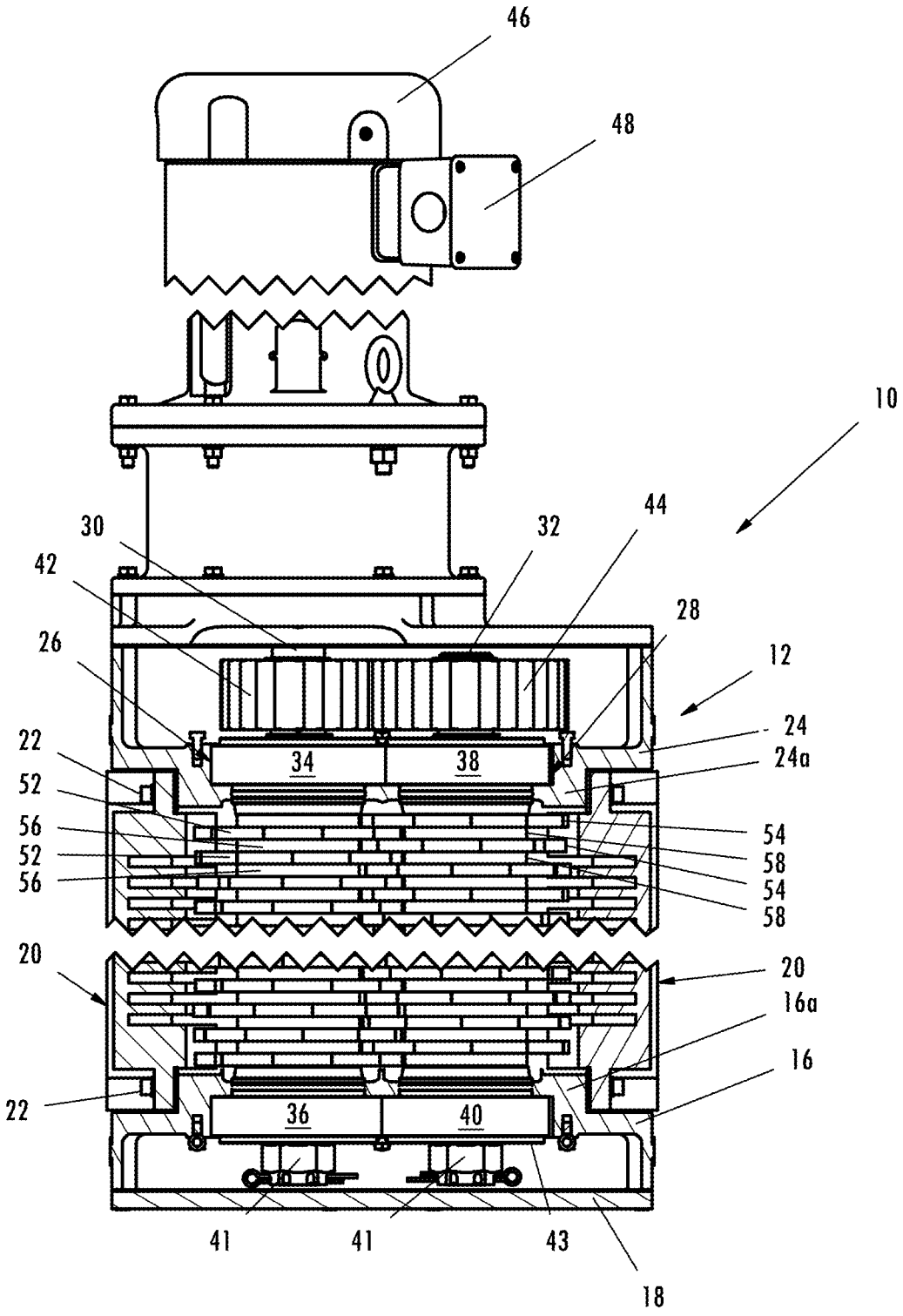
FIG. 1 is a comminutor in the related art.
Figure 2A:
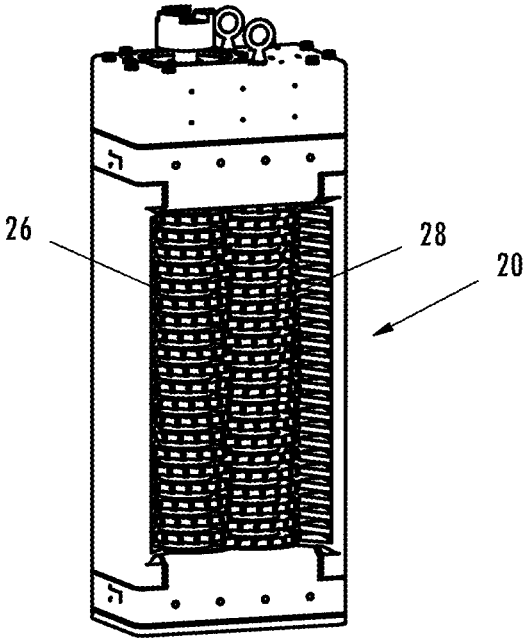
FIG. 2A is a side rail in the related art and FIG. 2B shows a segment of that side rail.
Figure 2B:
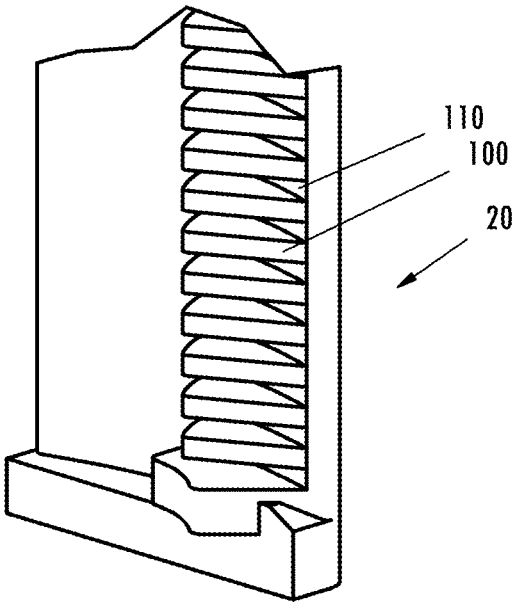
Figure 3A:
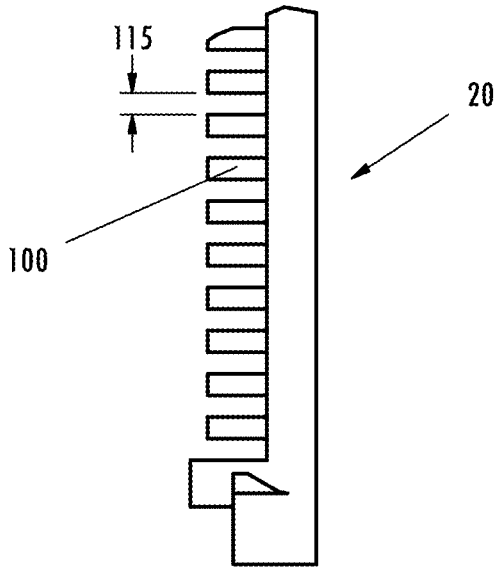
FIG. 3A shows a flow direction view and FIG. 3B shows a orthogonal view of a segment of the side rail of FIG. 2B.
Figure 3B:
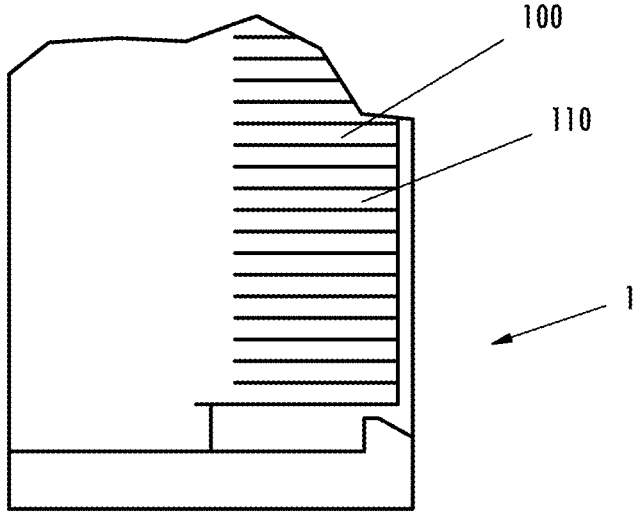
Figure 4A:
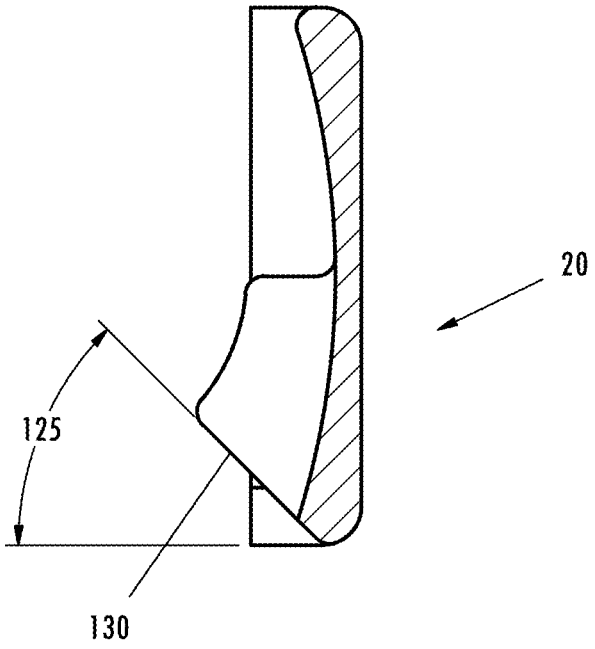
FIG. 4A shows a top view of a related art fin on a side rail and FIG. 4B shows a perspective view of the same.
Figure 4B:
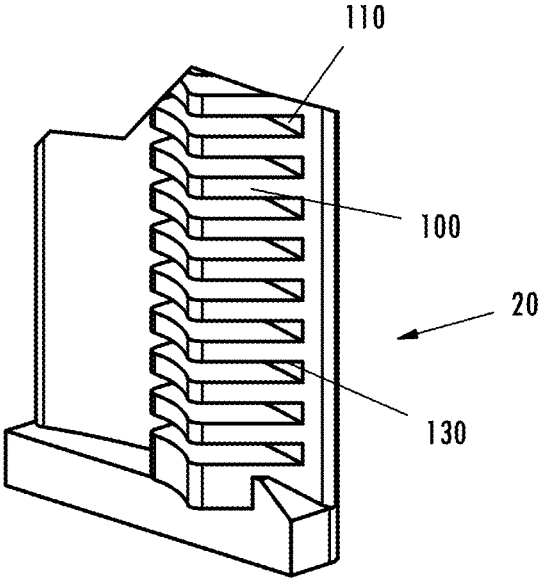
Figure 5A:
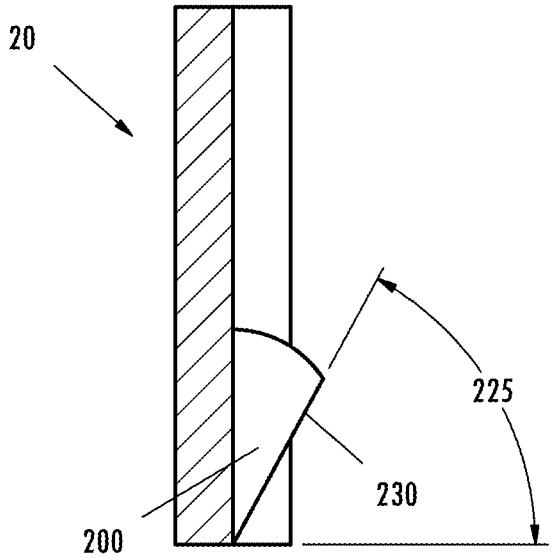
FIGS. 5A and 5B show a top view and a perspective view of a fin on a side rail in accord with an embodiment of the present application.
Figure 5B:
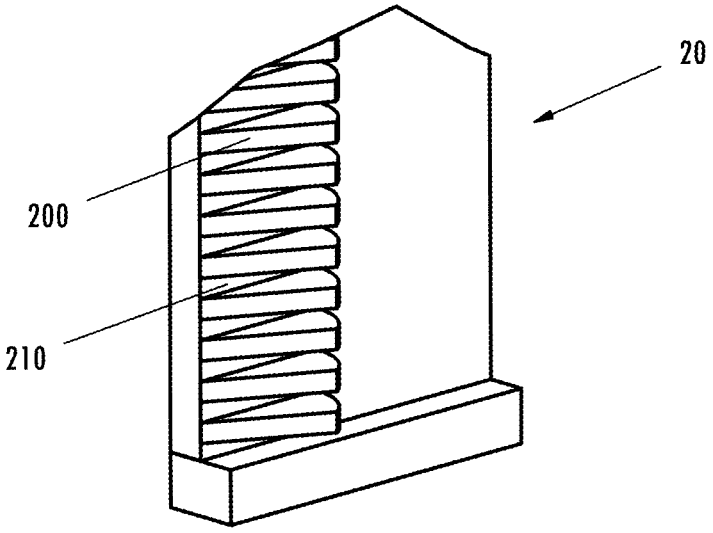
Figure 6:
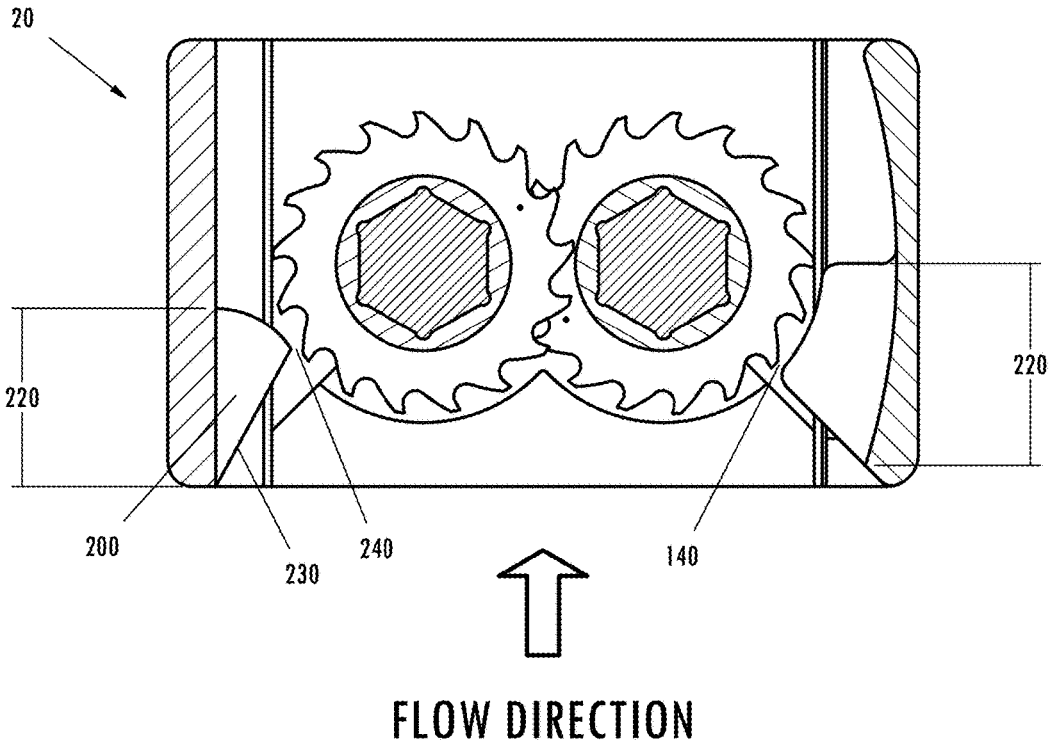
FIG. 6 shows a comparison between a fin according to an embodiment of the application (left side) compared to a related art fin (right side)
Figure 8:
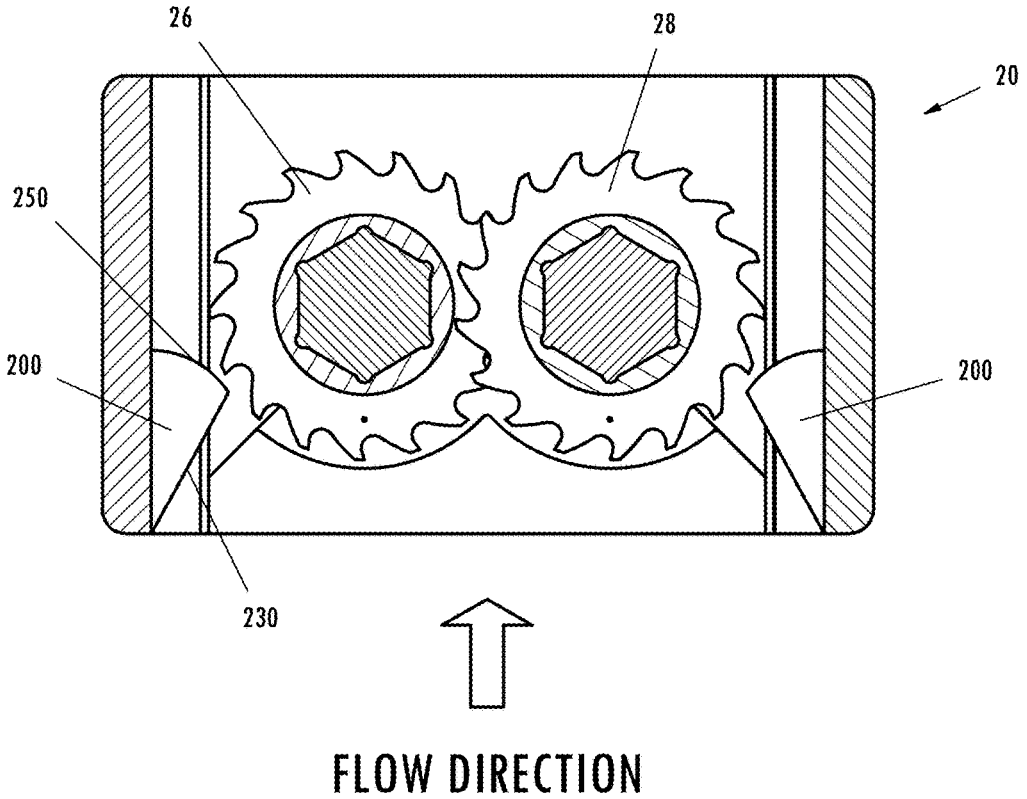
FIG. 8 shows an embodiment with fins upstream of the cutter elements.
Figure 8:
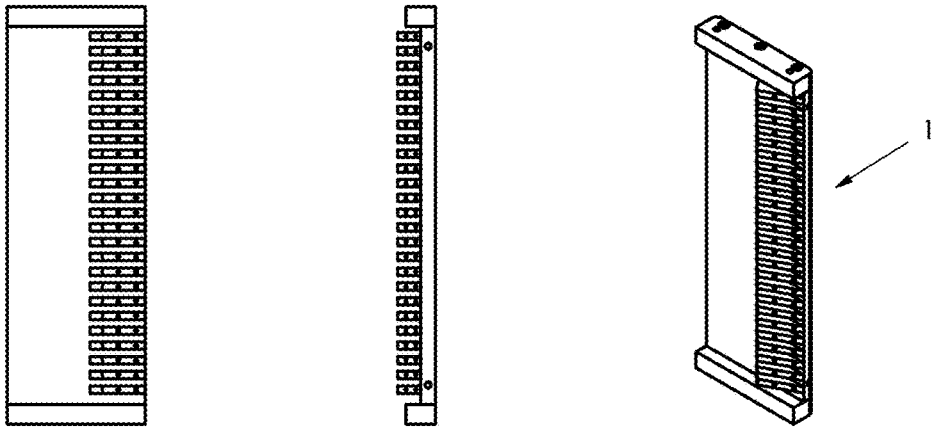

An aspect of this application is to improve on existing designs by providing a side rail structure that directs more solids into the cutting elements (prevents bypass of solids) while reducing the stapling of solids on the rail structure. As shown in FIGS. 5A, 5B and 8, the new design consists of horizontal fins and slots, a highly-raked leading surface, shortened length of flow passage (FIG. 6) and smaller clearance (FIG. 6) between cutters and fins, resulting in higher flow capacity, improved capture effectiveness and minimized stapling.

Figure 18:
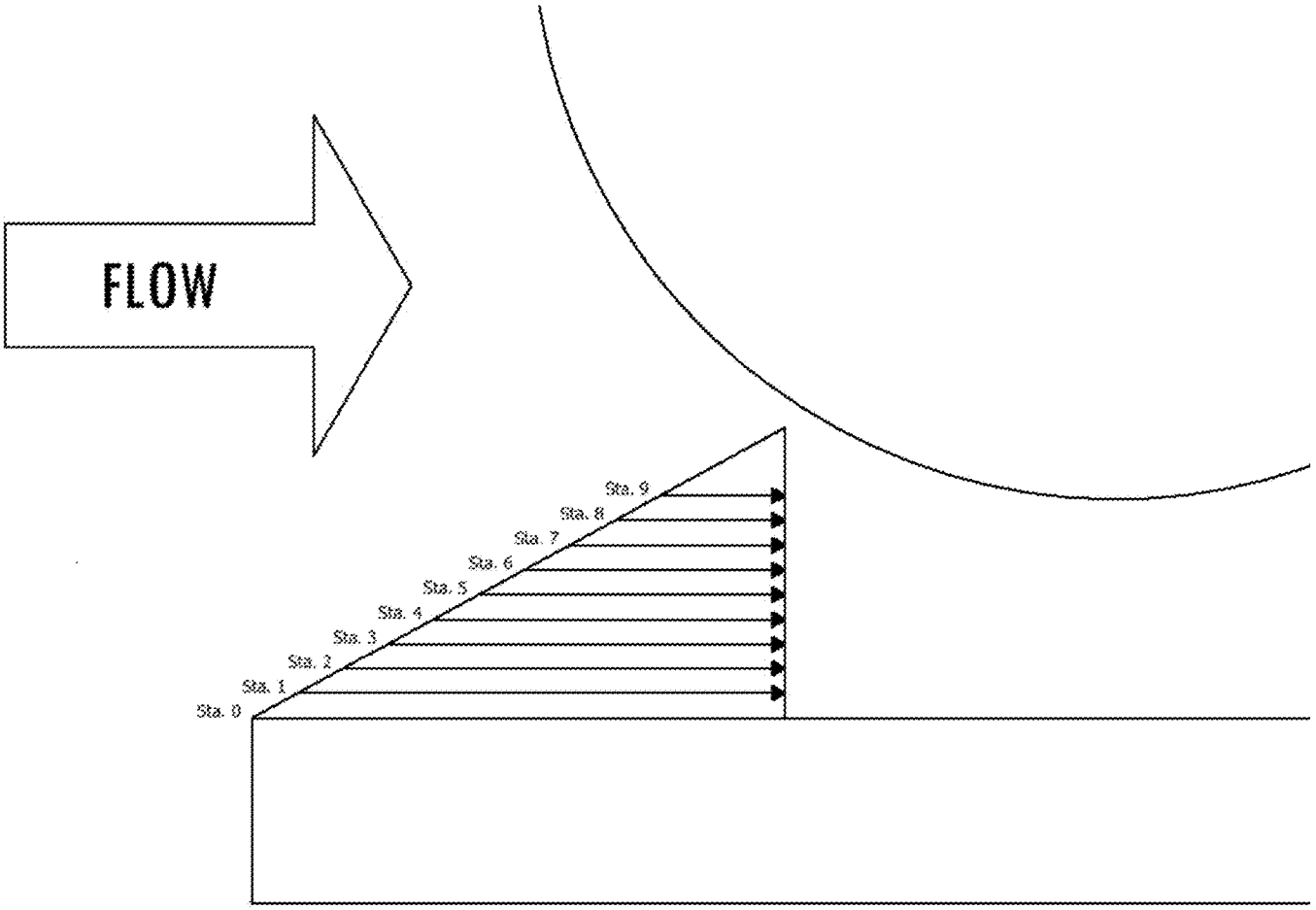
FIG. 18 shows a triangular shaped fin in accord with an embodiment.

The highly-raked leading surface 230 and abbreviated trailing surface 250 create a fin 200 geometry where there is a shorter flow path tangent 220 to the cutter stacks 26, 28 and longer flow path away the cutter stacks. (FIGS. 15 and 16 show the difference in flow paths between old and new, and FIGS. 13-17 show a comparison between the paths.) The rake angle 225 can range from 55 to 75 degrees. In the embodiments shown in FIGS. 17 and 18, the rake angle is 61.5 degrees in the embodiments showing a constant rake angle. This geometry creates a length-of-path differential between the fins 200 and as a consequence a pressure gradient is developed between the rails 20 and the cutter stacks 26, 28. That is, due to this structure, the pressure in each slot 110 is lowest adjacent to the cutter stacks 26, 28 and highest away from the cutter stacks 26, 28. As a result, there is a lateral flow toward to the cutters of each stack (see FIGS. 5A and 5B). This lateral flow results in dramatically-reduced stapling and improves feeding of material into the cutter stacks 26, 28 (see FIG. 12).

The new geometry reduces the overall surface area of each fin A lower average pressure drop through the comminutor promotes improved hydraulic capacity (see and compare FIG. 4A-5C). Because of the higher hydraulic efficiency, the gap 215 between the side rail and the cutter stack can be decreased as compared to the gap 210 in the related art, further reducing bypass (see FIG. 6).

Figure 7:
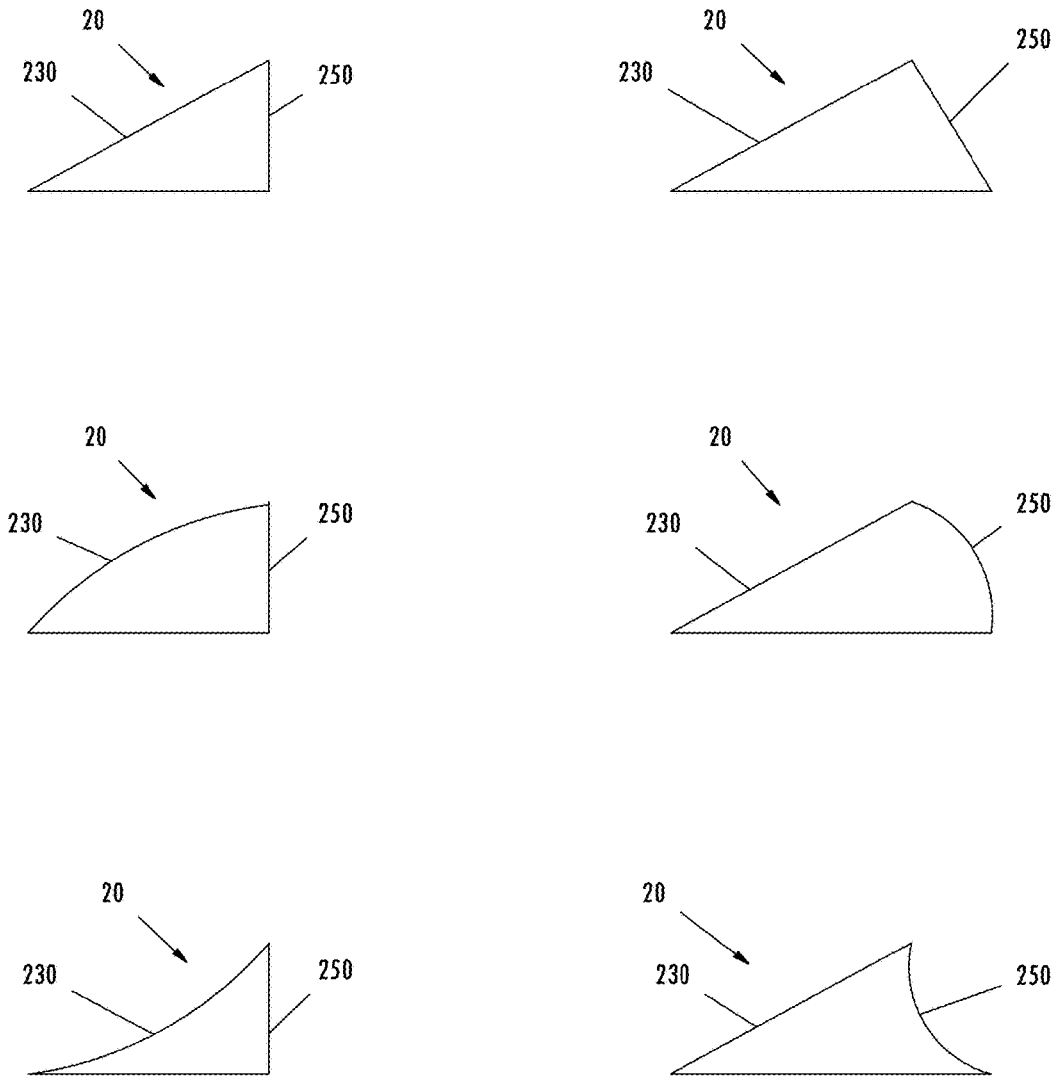
FIG. 7 shows various fin shapes in accord with embodiments of the present application.

There are several embodiments of fin shapes that provides the benefits described above. FIG. 7 shows variants of leading edge 230 and trailing edge 250 designs that can provide the flow benefits described herein. The leading edge 230 can be a straight edge, a convex curve or a concave curve. In the case of a straight leading edge, the rake angle 225 is constant. However, the rake angle 225 need not be constant. For example, in the case of a convex curve shape, the angle can begin rather steep (55 degrees) and decrease to 75 degrees (the angle being measured from a perpendicular to the side wall). By contrast, in the case of a concave curve, the rake angle begins as at a maximum value of 90 degrees (e.g., 0 degrees from the flow direction) and decreases toward the cutter stack.

In addition, the trailing edges 250 can take on a variety of shapes in combination with any of the leading edge variants to provide the flow advantages described above. Similar to the leading edge variates, the leading edge 250 can take a straight shape, a convex shape or a concave shape as shown in FIG. 7.

Figure 9:
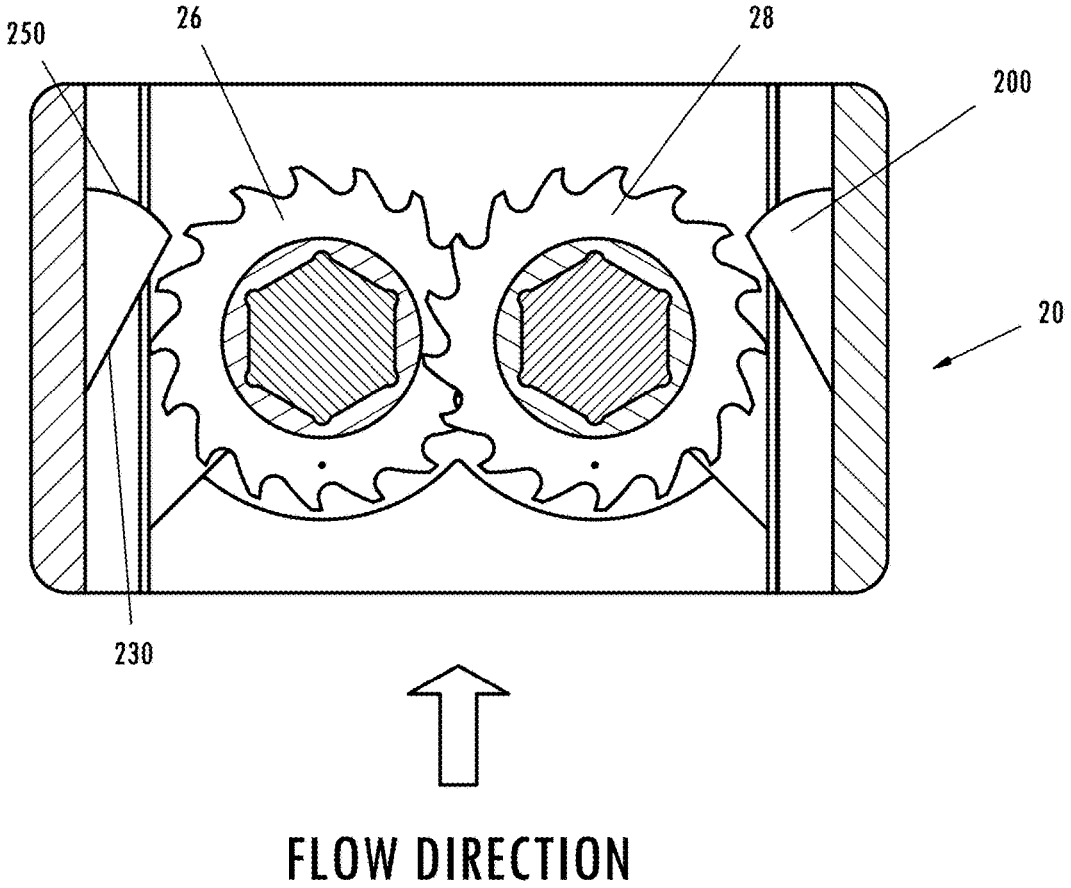
FIG. 9 shows an embodiment with fins located downstream of the leading edge of the cutter elements.
Figure 9:
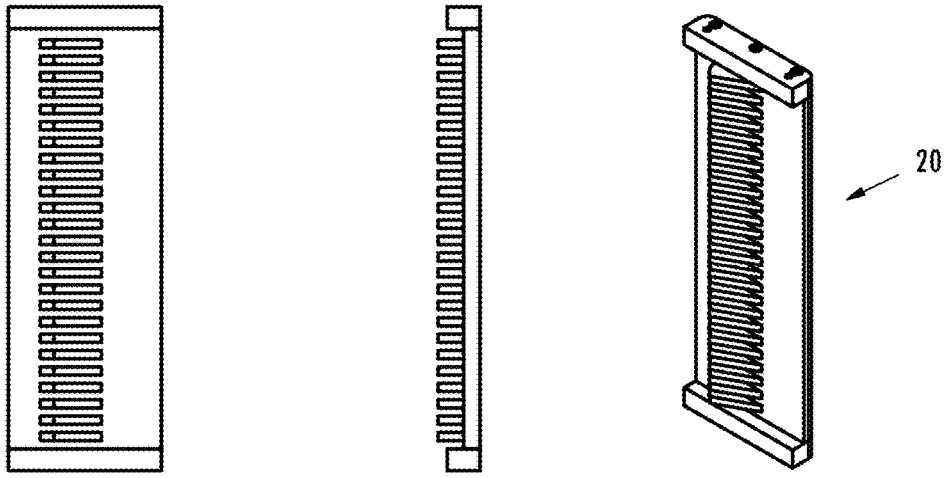

In another aspect of the application, the fins can be positioned in various locations to improve the function of the cutter stacks 26, 28. In one embodiment as shown in FIG. 8, the fins 200 are arranged upstream of the cutter stacks 26, 28 and overlapping the front leading edge of the cutter stacks when viewed from a direction orthogonal to the direction of the flow. When positioned in this location, the trailing edge 250 of the fins 200 is placed within a predetermined clearance of the cutter elements (0.10-0.15"). Alternatively, as shown in FIG. 9, the fins may be placed downstream of the leading edge of the cutter stacks. When positioned in this location, the leading edge 230 is placed within a predetermined clearance of the cutter elements (0.10-0.15").

Figure 10:
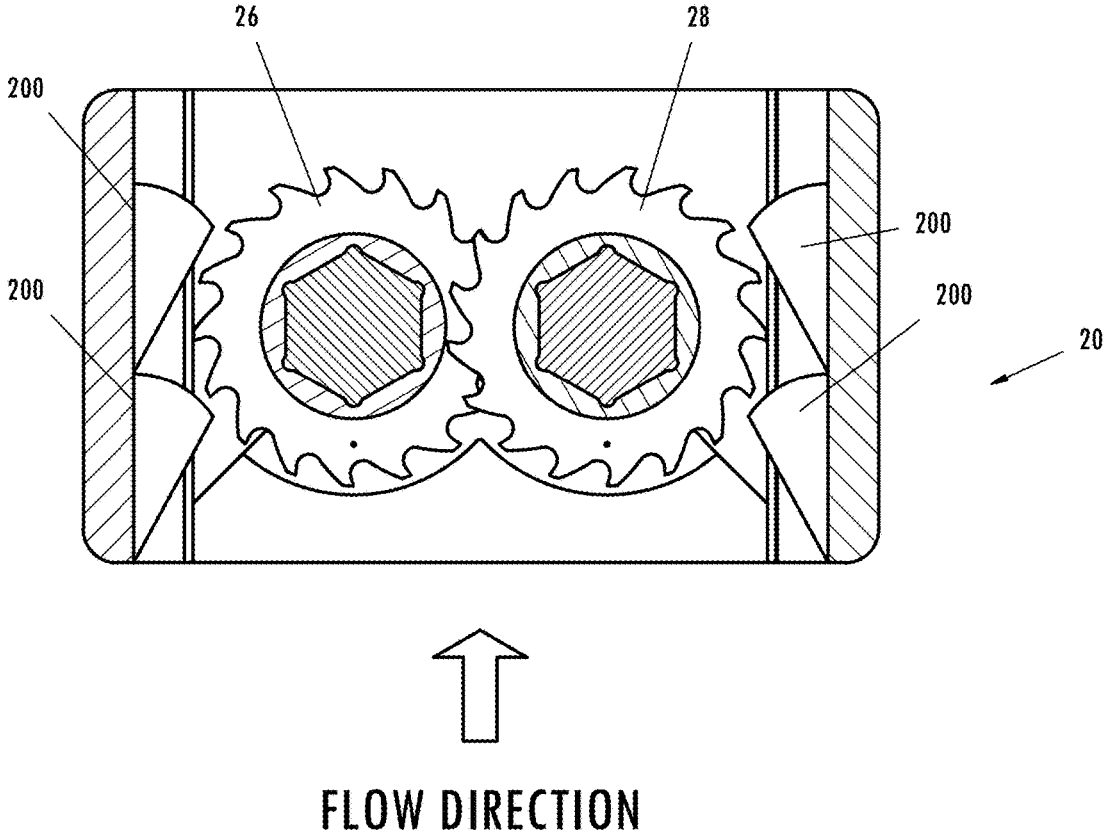
FIG. 10 shows an embodiment with fins located in an upstream and downstream position in a vertically staggered manner.
Figure 10:
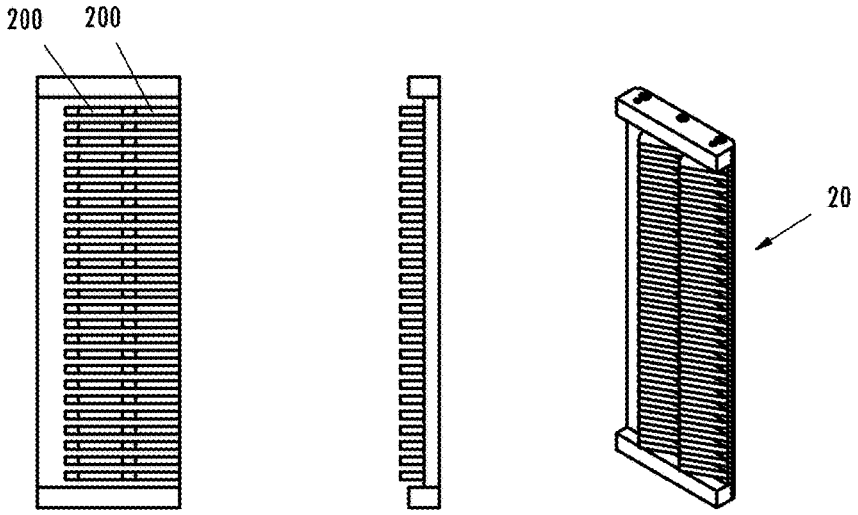
Figure 11:
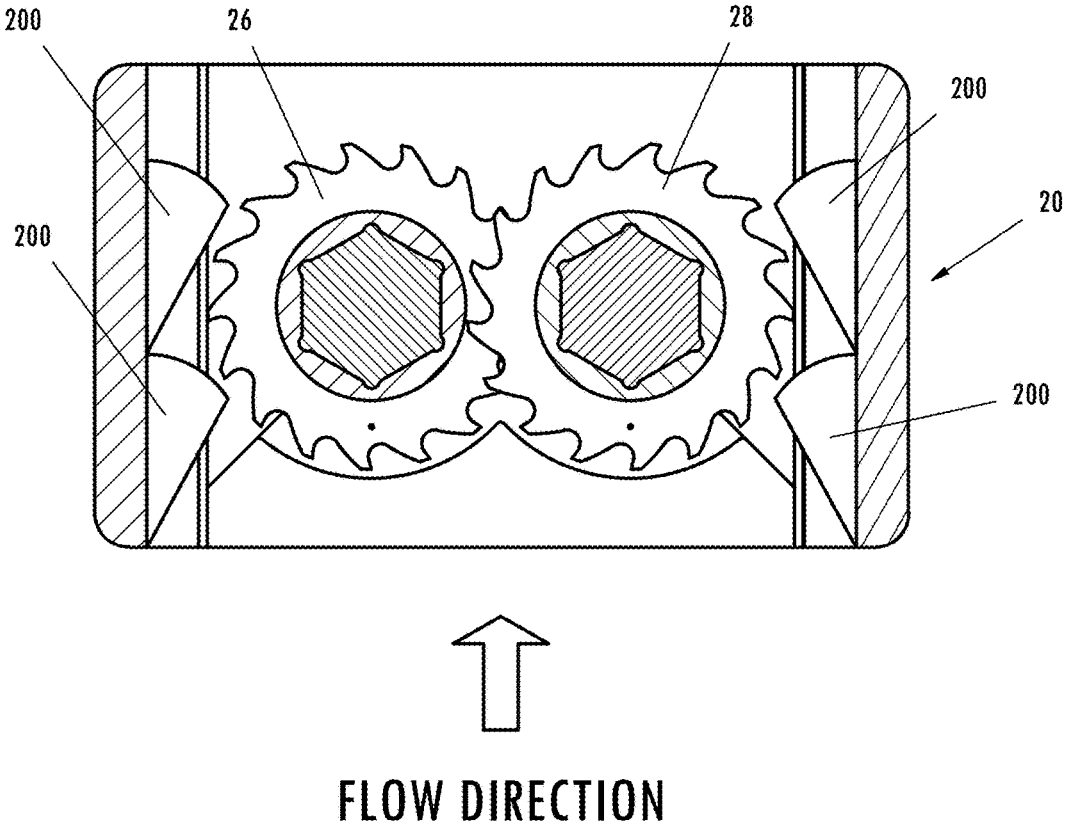
FIG. 11 shows an embodiment with fins located in an upstream and downstream position in a vertically aligned manner.
Figure 11:
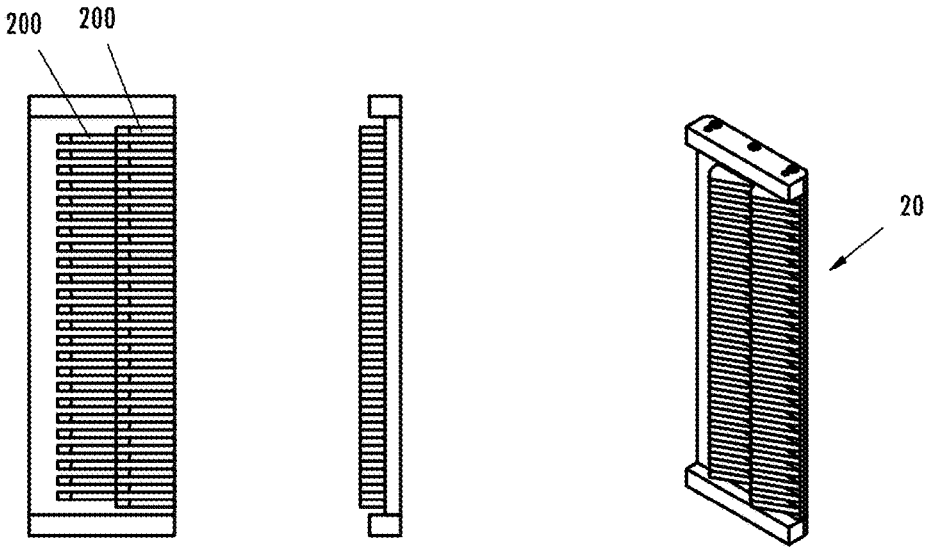

FIGS. 10 and 11 show other embodiments where fins 200 are placed both in the upstream position of FIG. 8 and the downstream position of FIG. 9. In FIG. 10, the upstream fins downstream fins are placed in a staggered manner. That is, the fins are staggered vertically so that the slot 210 of an upstream fin corresponds to a downstream fin and vice versa. Alternatively, as shown in FIG. 11, the upstream fins and the downstream fins may be placed so as to be aligned vertically. When positioned in this manner, the corresponding fins and slots are aligned in the horizontal direction.

FIG. 12 shows the result of testing to determine how the new designs responded to stapling effects using 1" wide strips. The test was conducted by feeding 1" wide strips into a flow stream and counting how many of the strips stapled (wrapped) the fins and how many passed through the comminutor. The comparative production side rail using the fin of FIG. 15 realized stapling at a rate of 60% under the test conditions. In comparison, the "cheese wedge" fin of FIG. 17 and the "half shield" fin of FIG. 16 experienced no stapling under the testing conditions.

Figure 13:
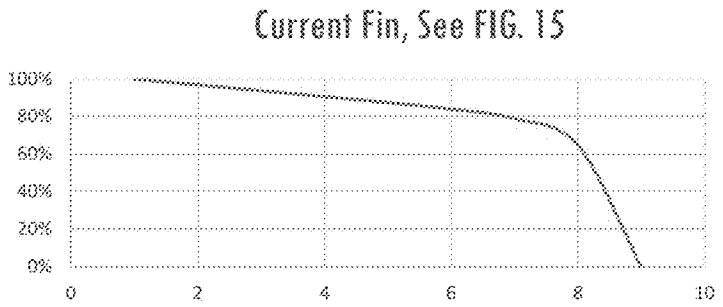
FIG. 13 shows flow length path ratios of the fins shown in FIGS. 15 and 16.
Figure 13:
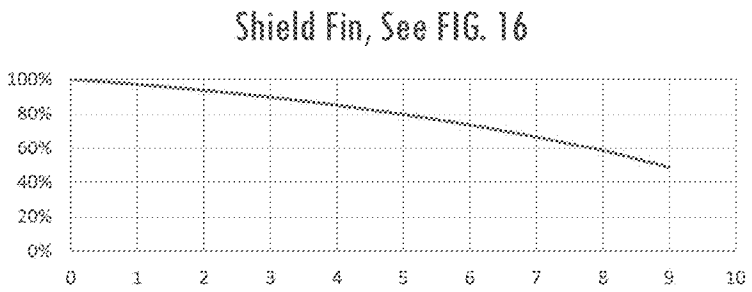
Figure 14:
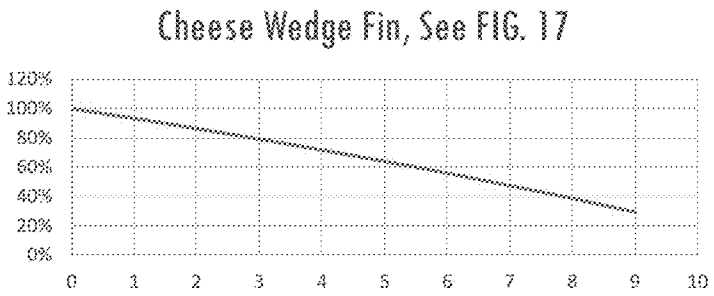
FIG. 14 shows flow length path ratios of the fins shown in FIGS. 17 and 18.
Figure 14:
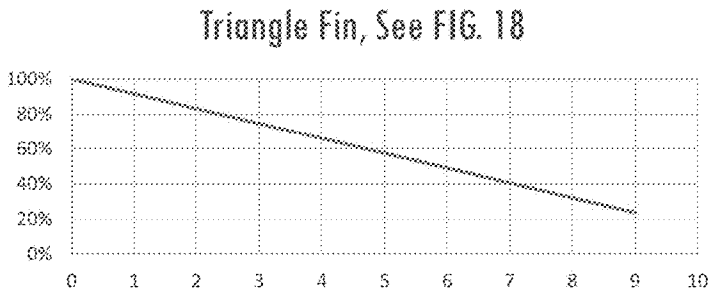
Figure 15:
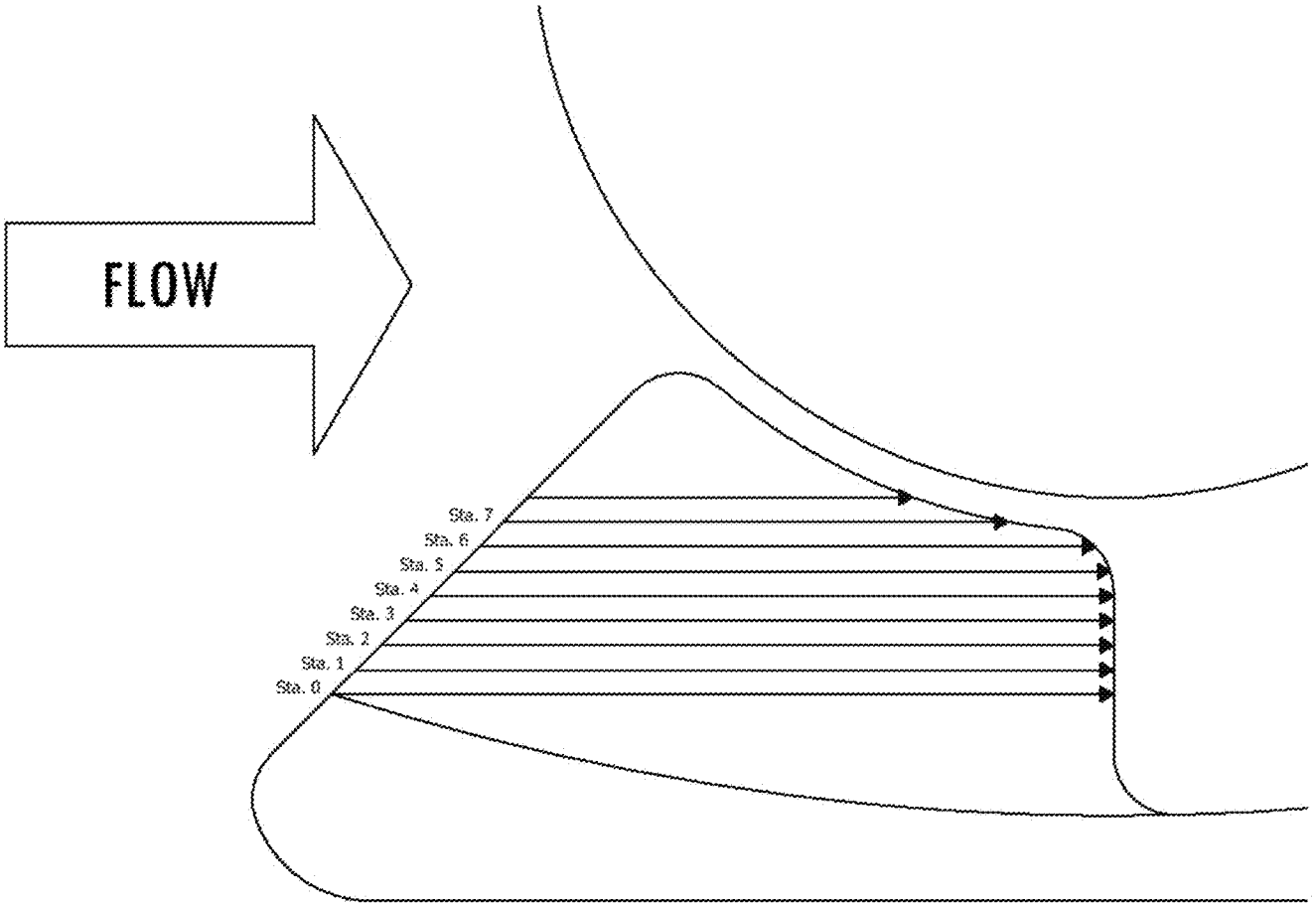
FIG. 15 shows a prior art fin.
Figure 16:
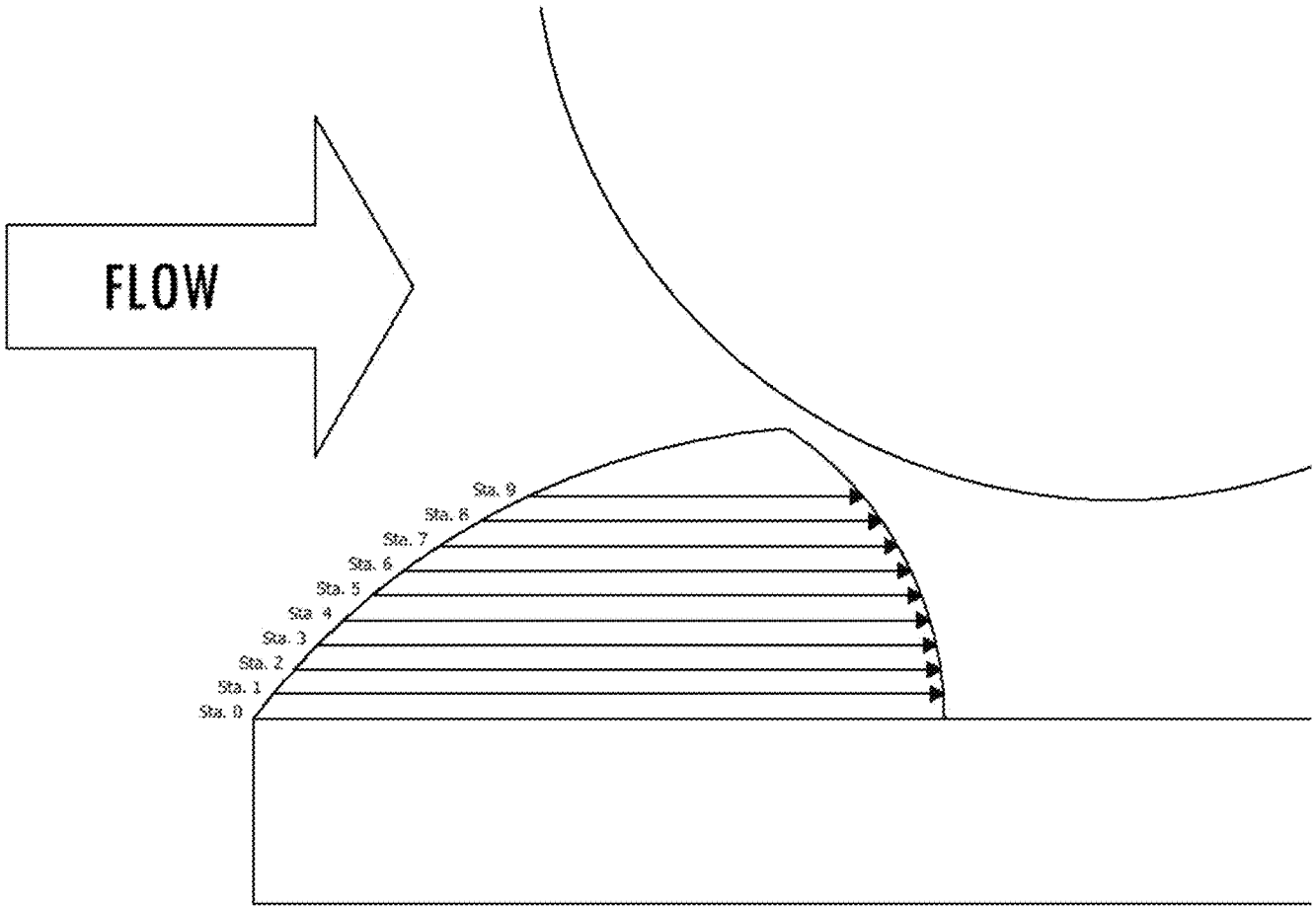
FIG. 16 shows a half shield shaped fin in accord with an embodiment.
Figure 17:
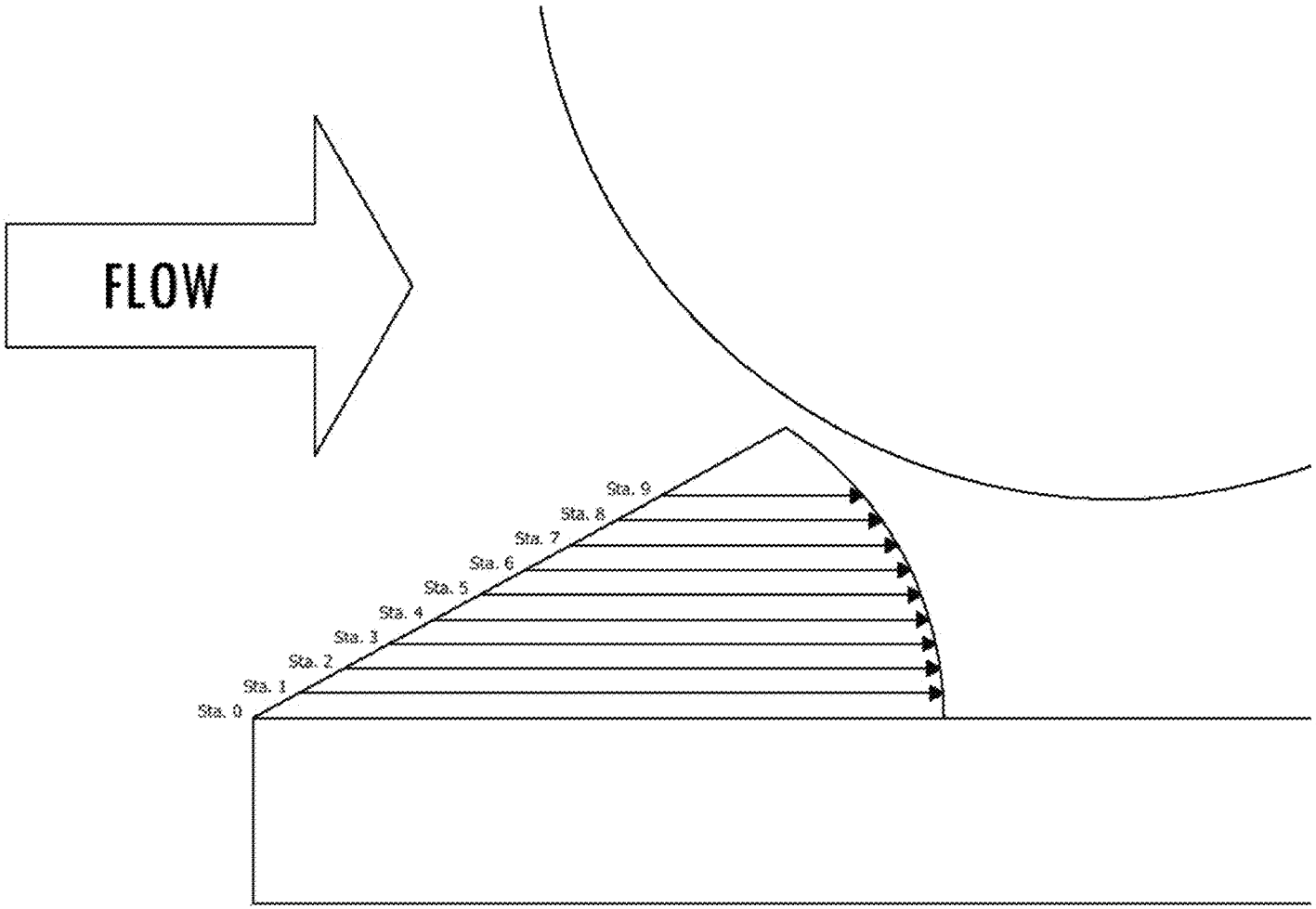
FIG. 17 shows a cheese wedge shaped fin in accord with an embodiment.

FIGS. 13-14 show the path length ratios (amount of reduction in length per unit distance from the side rail side of the fin) of the fins of FIGS. 15-18. As is evidenced by these tables, the path length ratios decrease at a faster rate and begin decrease at locations closer to the side rail as compared to the conventional fins. The path ratio (path length ratio) is calculated by taking the maximum flow path length and dividing it by the minimum flow path length (Max FPL/Min. FPL). The maximum flow path length is defined as the longest parallel flow vector across the fins of the side rail from the leading edge to the trailing edge. (Sta.0 in FIG. 15, 16, 17, 18). The minimum flow path length is defined as the shortest parallel flow vector across the fins of the side rail from the leading edge to the trailing edge, that is tangent to the adjacent cutter outside diameter (OD) (Sta.9 in FIG. 16, 17, 18,) (Sta.8 FIG. 15). Flow paths inside of the tangent of the cutter OD can be assumed obvious that the particle would contact the cutter. Creating too large a ratio could have an adverse effect on flow capacity performance by creating unwanted surface friction.

Figure 19:
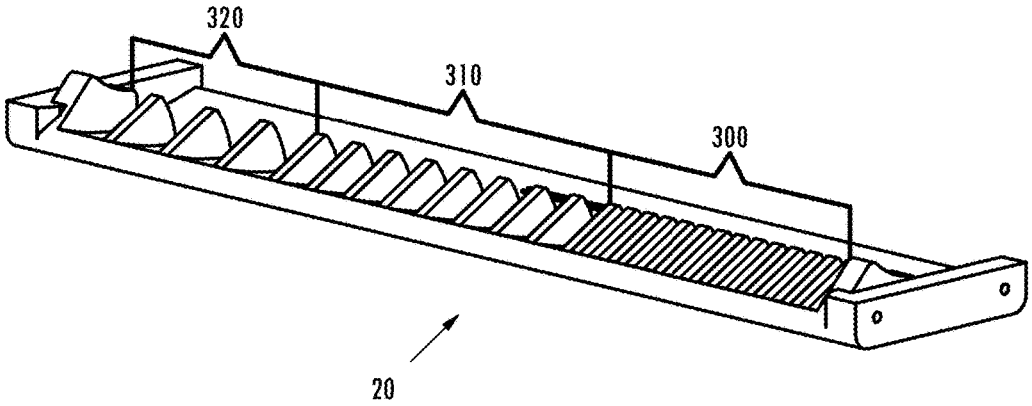
FIG. 19 shows a progressive side rail in accord with another embodiment.

FIG. 19 is shows an embodiment according to another aspect of the application. This progressive side rail design, progressively improves flow performance as the waste stream's water level rises by increasing the open area of the side rail 20. The lower zone 300 of the side rail uses a 50% open area to capture solids and pass flow, as the water level rises to next zone 310 of the side, openings between the fins are increased to 66%. The final zone 320 of the side rail use a 75% to 100% open area to gain optimum flow performance. The progressive side rail improves the form of the solution to provide increased flow capacity without severely sacrificing solids capture performance.

What is claimed is:

1. An apparatus for comminuting solid waste material comprising:

a casing defining a comminution chamber and being open on opposite sides thereof for permitting the flow of liquid therethrough bearing solid waste material;

said casing including an underlying base and an overlying head;

a comminutor assembly including cooperating parallel first and second shredding stacks comprising:

first and second parallel shafts mounted for rotation at opposite ends within said base and said head respectively;

a plurality of cutting elements mounted on said first shaft in interspaced relationship with a plurality of second cutting elements mounted on said second shaft, said cutting elements being positioned between and separated in an axial direction by spacers which are coplanar with the cutting elements of the adjacent stack such that a cutting element from one stack and a spacer from the other stack form a pair of interactive shredding members, and wherein said casing includes laterally opposed side rails extending between the base and said head to the outside of respective stacks for controlling the flow of the liquid through the comminution chamber from one side to the other and for causing the solid waste to be deflected into the path of rotating cutting elements of said stacks;

each of said side rails comprises:

a side wall extending parallel to a flow direction of the liquid through the comminution chamber, a plurality of planar fins projecting outwardly of said side wall in the direction of said stack, aligned with the flow direction of the liquid and being spaced from each other in a vertical direction to form slots therebetween, wherein the planar fins having a leading edge extending from the side wall upstream a rearward edge, the rearward edge extending from an outermost portion of the leading edge toward the side wall, and the planar fins have a path ratio greater than 1.55 to 1.

2. The apparatus for comminuting solid waste material according to claim 1, wherein the planar fins have a path ratio ranging from 2.05-4.26 to 1.

3. The apparatus for comminuting solid waste material according to claim 1, wherein the leading edge has a rake angle, as defined with respect to a perpendicular from the side wall surface between the planar fins, within a range of 55 to 70 degrees.

4. The apparatus for comminuting solid waste material according to claim 1, wherein the leading edge of the planar fins are disposed upward in the flow direction from the cutting elements.

5. The apparatus for comminuting solid waste material according to claim 1, wherein the leading edge of the planar fins is adjacent the cutting elements.

6. The apparatus for comminuting solid waste material according to claim 4, wherein a clearance is formed between the rearward edge of the planar fins and the cutter elements, the clearance being within the range of 0.10-0.15 inches, inclusive.

7. The apparatus for comminuting solid waste material according to claim 5, wherein a clearance is formed between the leading edge of the planar fins and the cutter elements, the clearance being within the range of 0.10-0.15 inches, inclusive.

8. The apparatus for comminuting solid waste material according to claim 1, wherein the plurality of planar fins includes two rows of fins extending vertically, one row downstream in the flow direction from another row.

9. The apparatus for comminuting solid waste material according to claim 8, wherein the planar fins of the one row and aligned with the slots of the other row.

10. The apparatus for comminuting solid waste material according to claim 8, wherein the planar fins of the one row are aligned with the planar fins of the other row.

11. An apparatus for comminuting solid waste material comprising:

a casing defining a comminution chamber and being open on opposite sides thereof for permitting the flow of liquid therethrough bearing solid waste material;

said casing including an underlying base and an overlying head;

a comminutor assembly including cooperating parallel first and second shredding stacks comprising:

first and second parallel shafts mounted for rotation at opposite ends within said base and said head respectively;

a plurality of cutting elements mounted on said first shaft in interspaced relationship with a plurality of second cutting elements mounted on said second shaft, said cutting elements being positioned between and separated in an axial direction by spacers which are coplanar with the cutting elements of the adjacent stack such that a cutting element from one stack and a spacer from the other stack form a pair of interactive shredding members, and wherein said casing includes laterally opposed side rails extending between the base and said head to the outside of respective stacks for controlling the flow of liquid through the comminution chamber from one side to the other and for causing the solid waste to be deflected into the path of rotating cutting elements of said stacks;

each of said side rails comprises:

a side wall extending parallel to the flow direction of the liquid through the comminution chamber, a plurality of planar fins projecting outwardly of said side wall in the direction of said stack, aligned with the flow direction of the liquid and being spaced from each other in a vertical direction to form slots therebetween, wherein the planar fins have a leading edge extending from the side wall upstream a rearward edge, the rearward edge extending from an outermost portion of the leading edge toward the side wall, and the leading edge has a rake angle, as defined with respect to a perpendicular from the side wall surface, within a range of 55 to 70 degrees.

12. The apparatus for comminuting solid waste material according to claim 11, wherein the planar fins have a path ratio ranging from 2.05-4.26 to 1.

13. The apparatus for comminuting solid waste material according to claim 11, wherein the leading edge of the planar fins are disposed upward in the flow direction from the cutting elements.

14. The apparatus for comminuting solid waste material according to claim 11, wherein the leading edge of the planar fins is adjacent the cutting elements.

15. The apparatus for comminuting solid waste material according to claim 13, wherein a clearance is formed between the rearward edge of the planar fins and the cutter elements, the clearance being within the range of 0.10-0.15 inches, inclusive.

16. The apparatus for comminuting solid waste material according to claim 14, wherein a clearance is formed between the leading edge of the planar fins and the cutter elements, the clearance being within the range of 0.10-0.15 inches, inclusive.

17. The apparatus for comminuting solid waste material according to claim 11, wherein the plurality of fins includes two rows of planar fins extending vertically, one row downstream in the flow direction from another row.

18. The apparatus for comminuting solid waste material according to claim 17, wherein the planar fins of the one row and aligned with the slots of the other row.

19. The apparatus for comminuting solid waste material according to claim 17, wherein the planar fins of the one row and aligned with the planar fins of the other row.

20. An apparatus for comminuting solid waste material comprising:

a casing defining a comminution chamber and being open on opposite sides thereof for permitting the flow of liquid therethrough bearing solid waste material;

said casing including an underlying base and an overlying head;

a comminutor assembly including cooperating parallel first and second shredding stacks comprising:

first and second parallel shafts mounted for rotation at opposite ends within said base and said head respectively;

a plurality of cutting elements mounted on said first shaft in interspaced relationship with a plurality of second cutting elements mounted on said second shaft, said cutting elements being positioned between and separated in an axial direction by spacers which are coplanar with the cutting elements of the adjacent stack such that a cutting element from one stack and a spacer from the other stack form a pair of interactive shredding members, and wherein said casing includes laterally opposed side rails extending between the base and said head to the outside of respective stacks for controlling the flow of liquid through the comminution chamber from one side to the other and for causing the solid waste to be deflected into the path of rotating cutting elements of said stacks;

each of said side rails comprises:

a side wall extending parallel to the flow direction of the liquid through the comminution chamber, a plurality of planar fins projecting outwardly of said side wall in the direction of said stack, aligned with the flow direction of the liquid and being spaced from each other in a vertical direction to form slots therebetween, wherein a clearance in the vertical direction between the slots is greater at slots disposed above slots disposed at a lower part of the side wall.

* * * * *